US006334342B1

(12) United States Patent
Cho

(10) Patent No.: US 6,334,342 B1
(45) **Date of Patent: *Jan. 1, 2002**

(54) WASHING MACHINE HAVING HORIZONTALLY MOVING WASHING PLATES

(75) Inventor: In-Su Cho, Kwangju (KR)

(73) Assignee: Daewoo Electronics Co., Ltd., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/074,418

(22) Filed: May 8, 1998

(30) Foreign Application Priority Data

May 9, 1997 (KR) ..... 97-17788

(51) Int. Cl.[7] ..... D06F 17/08; D06F 17/10

(52) U.S. Cl. ..... 68/133; 68/134

(58) Field of Search ..... 68/133, 134

(56) References Cited

U.S. PATENT DOCUMENTS 5,596,891 A * 1/1997 Bae et al. ..... 68/134 X

* cited by examiner

*Primary Examiner*—Philip R. Coe
(74) *Attorney, Agent, or Firm*—Smith, Gambrell & Russell, LLP.

(57) ABSTRACT

A washing machine having horizontally moving washing plates is disclosed. The washing machine comprises an inner tub for receiving a detergent water and a laundry; a pulsator for agitating the detergent water which is rotatably mounted in an interior of the inner tub; a driving unit for rotating in forward and reverse directions the pulsator which is disposed on an exterior of the inner tub, the driving unit having a washing shaft which is connected to the pulsator; and a washing means for bumping against the laundry which is disposed on the pulsator and is horizontally reciprocated by the driving unit to wash the laundry. Therefore, washing efficiency is increased.

17 Claims, 10 Drawing Sheets

WASHING MACHINE HAVING HORIZONTALLY MOVING WASHING PLATES

BACKGROUND OF THE INVENTION

1. Field of the Invention

The present invention relates to a washing machine, more particularly to a washing machine having horizontally moving washing plates.

2. Description of the Prior Art

In general, a washing machine includes a pulsator for agitating a detergent water which is repeatedly rotated in forward and reverse directions. The detergent water which is supplied in the washing machine forms a heart-type water flow caused by the rotation of the pulsator, so that laundry congregates and entwines in the upper part of the pulsator.

U.S. Pat. No. 5,473,915 (issued to Woon-Gu Hur et al.) discloses a washing machine for preventing laundry from congregating in the upper portion of the pulsator. The Woon-Gu Hur et al's washing machine is explained with reference to an attached figure of FIG. 1. FIG. 1 is a vertical sectional view of a pulsator of a conventional washing machine.

A pulsator 11 having a base 11*a* and a plurality of blades 11*b* is rotatably installed in inner tub 10, and a driving unit (not shown) for rotating in forward and reverse directions the pulsator 11 is fixedly disposed on an exterior of the inner tub 10. A washing shaft 12 extending from the driving unit and for transmitting a rotatory power of the driving unit into the pulsator 11 is connected to the pulsator 11. A variable-length washing rod 20 is mounted on the central area of the pulsator 11, the washing rod 20 includes a first rod 21, a second rod 22, a connecting member 23 for connecting the second rod 22 with the first rod 21 and a buoy 24 which is installed in the second rod 22. When the detergent water is supplied into the inner tub 10, the buoy 24 floats by buoyancy. Accordingly, the second rod 22 and connecting member 23 are gradually ascended by the buoy 24, so that the second rod 22 and connecting member 23 prevent the laundry from congregating directly in the upper part of the washing rod 20.

The above-mentioned conventional washing machine has an advantage in that laundry does not congregate in the central upper part of the pulsator. However, the conventional washing machine has an drawback in that the buoy has to be submerged under the detergent water to ascend the buoy. That is, a large quantity of the detergent water is supplied into the inner tub to ascend the buoy.

SUMMARY OF THE INVENTION

The present invention has been provided to solve the aforementioned problem and it is an object of the present invention to provide a washing machine employing horizontally moving washing plates for bumping against the laundry, which can enhance washing efficiency.

In order to obtain the above-mentioned object of the present invention, there is provided a washing machine comprising: an inner tub for receiving a detergent water and a laundry; a pulsator for agitating the detergent water which is rotatably mounted in an interior of the inner tub; a driving unit for rotating in forward and reverse directions the pulsator which is disposed on an exterior of the inner tub, the driving unit having a washing shaft which is connected to the pulsator; and a washing means for bumping against the laundry which is disposed on the pulsator and is horizontally reciprocated by the driving unit to wash the laundry.

The washing means comprises a cylinder disposed on an upper surface of the pulsator, the cylinder having a opened lower surface, being independently rotated relative to the rotatory movement of the pulsator, wherein the cylinder rotates at a lower speed than that of the pulsator; a movement conversion means for converting the rotatory movement of the washing shaft into linear movement which is disposed in the cylinder; and a plurality of washing plates for being horizontally reciprocated by the movement conversion means and for bumping against the laundry, which is positioned in an exterior of the cylinder.

A supporting member is disposed on the upper surface of the pulsator, the supporting member encloses a side surface of the cylinder for supporting the cylinder and for preventing the cylinder from floating by buoyancy.

A fixing hole is formed at the pulsator, and a fixing protrusion is inserted into the fixing hole and is extended from the supporting member.

An inner and an outer frames are respectively extended from a bottom end of the cylinder in an inward and an outward directions of the cylinder, bearings are respectively installed between the inner frame and the pulsator, and between the outer frame and an upper surface of the supporting member for sliding the cylinder relative to the rotatory movement of the pulsator and the supporting member.

Depression portions for placing the bearings are respectively formed at the inner and outer frames.

The movement conversion means comprises a crank installed in an interior of the supporting member, a top end of the crank being supported by the cylinder, and a bottom end of the crank being connected to the washing shaft so that the crank is rotated by the washing shaft; and a rod for converting the rotatory movement of the crank into a linear movement and for transmitting the linear movement into the washing plates, a first end of the rod being connected to the crank and a second end of the rod being connected to the washing plates.

A piercing hole being pierced by the rod is formed at the cylinder, a diameter of the piercing hole toward a rotatory direction of the crank is longer than that toward a length direction of the crank so that the piercing hole has an elliptical shape.

The top end of the crank is formed into a round shape and the bottom end of the crank is formed into a polygonal shape, a supporting cylinder for supporting the top end of the crank is formed at an upper surface of the cylinder, a inserting hole for being inserted the bottom end of the crank and having a polygonal shape corresponding to the bottom end of the crank end is formed at the washing shaft.

The first end of the rod is formed into a shape of a ring, a groove for being connected to the first end of the rod is formed at the crank.

A plurality of washing protrusions are formed on the washing plates to enlarge a contacting area between the laundry and the washing plates.n apparatus The washing mcahine is provided in washing plates which are horizontally reciprocated, so that the washing plates bump against the laundry and wash the laundry. Therefore, washing efficiency is increased.

BRIEF DESCRIPTION OF THE DRAWINGS

The above object and other advantages of the present invention will become more apparent by describing in detail a preferred embodiment thereof with reference to the attached drawings, in which.

DETAILED DESCRIPTION OF THE INVENTION

Hereinafter, a washing machine having horizontally moving washing plates according to a preferred embodiment of the present invention is explained in more detail with reference to the accompanying drawings.

Figure 1:
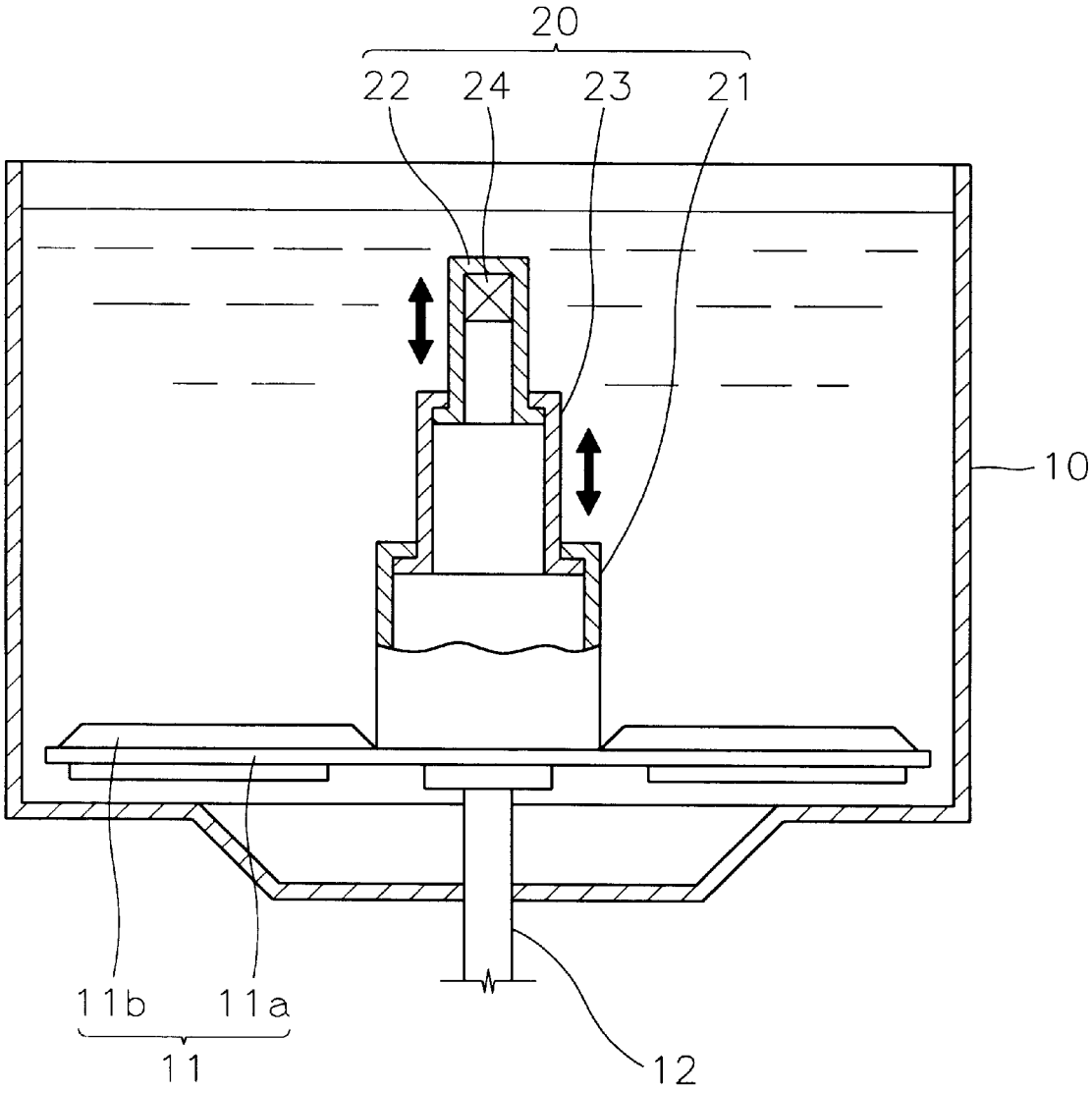
FIG. 1 (PRIOR ART)
FIG. 1 is a vertical sectional view of a pulsator of a conventional washing machine.
Figure 2:
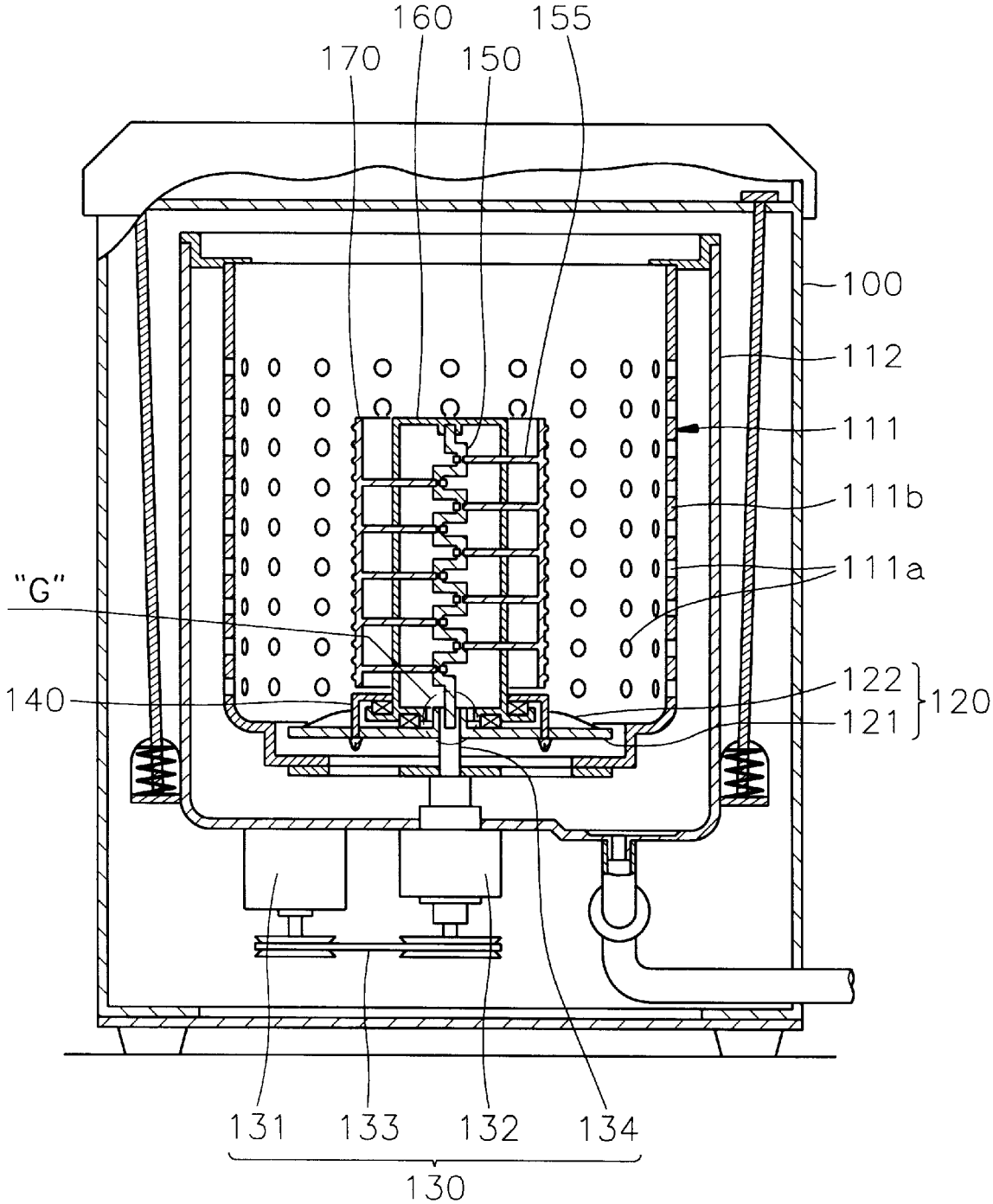
FIG. 2 is a vertical sectional view of a washing machine according to one embodiment of the present invention.

FIG. 2 is a vertical sectional view of a washing machine according to one embodiment of the present invention. As illustrated in FIG. 2, an outer tub 112 for receiving a detergent water is installed in a housing 100, an inner tub 111 for receiving a detergent water and a laundry is installed in the outer tub 112. A plurality of communicating holes 111*a* are formed at a side wall 111*b* of the inner tub 111, the detergent water which is supplied to the inner tub 111 flows into the outer tub 112 through the communicating holes 111*a*.

A pulsator 120 having a base 121 and a plurality of blades 122 is rotatably mounted in an interior of the inner tub 111, a driving unit 130 for rotating in forward and reverse directions the pulsator 120 is fixed at an exterior of the outer tub 112.

The driving unit 130 has a motor 131, a clutch 132 for selectively transmitting the rotatory motion provided by the motor 131 into the pulsator 120 and into the inner tub 111, and belt 133 for transmitting a rotatory motion by the motor 131 to the clutch 132. The clutch 132 has a washing shaft 134 passing through the outer tub 112 and inner tub 111, the washing shaft 134 is connected to the pulsator 120.

The washing machine according to one embodiment of the present invention has a plurality of washing plates 170 for washing the laundry which is horizontally reciprocated by a rotatory movement of the washing shaft 134 of the driving unit 130, a crank 150 and a plurality of rods 155 for converting the rotatory movement of the washing shaft 134 into a linear movement, a cylinder 160 for receiving the crank 150 and the rods 155, and a supporting member 140 for supporting the cylinder 160. These members will be explained with reference to FIGS. 3–8.

Figure 3A:
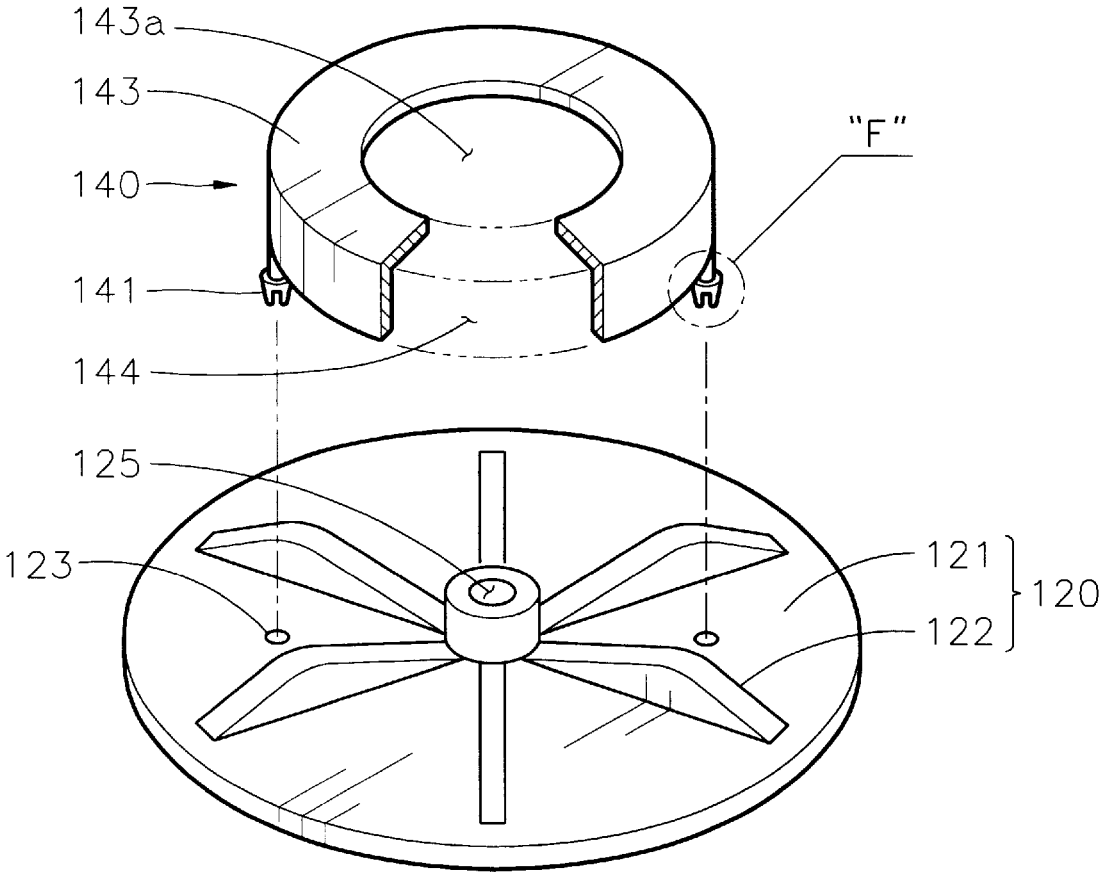
FIG. 3A is a disassembled perspective view of a pulsator and a supporting member according to one embodiment of the present invention.
Figure 3B:
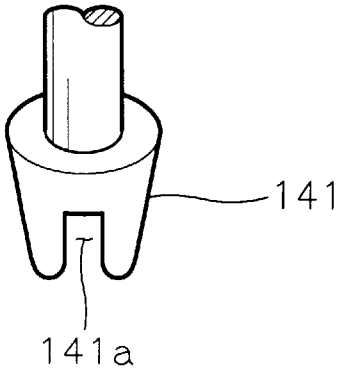
FIG. 3B is an exploded perspective view of a fixing protrusion according to one embodiment of the present invention.

FIG. 3A is a disassembled perspective view of a pulsator and a supporting member according to one embodiment of the present invention, and FIG. 3B is an exploded perspective view of a fixing protrusion according to one embodiment of the present invention. As can be seen in FIGS. 3A and 3B, a plurality of fixing holes 123 are formed at portions of the pulsator 120 which are located at outer areas of a hole 125 which is formed at a central portion of the pulsator 120 and into which the washing shaft 134 is inserted. A plurality of fixing protrusions 141 of the supporting member 140 is inserted into the fixing hole 123. A central portion 143*a* of an upper surface 143 and a bottom surface 144 of the supporting member 140 is opened, the fixing protrusions 141 are extended from a bottom end of the supporting member 140. A diameter of an end of the fixing protrusions 141 is longer than that of the fixing holes 123, so that the supporting member 140 and the pulsator 120 rotates as one unit. The end of the fixing protrusions 141 has a incised part 141*a* so that the fixing protrusions 141 has an elasticity. Also, the supporting member 140 encloses a side surface of the cylinder 160 to support the cylinder 160 and to prevent the cylinder 160 from floating by buoyancy.

Figure 4:
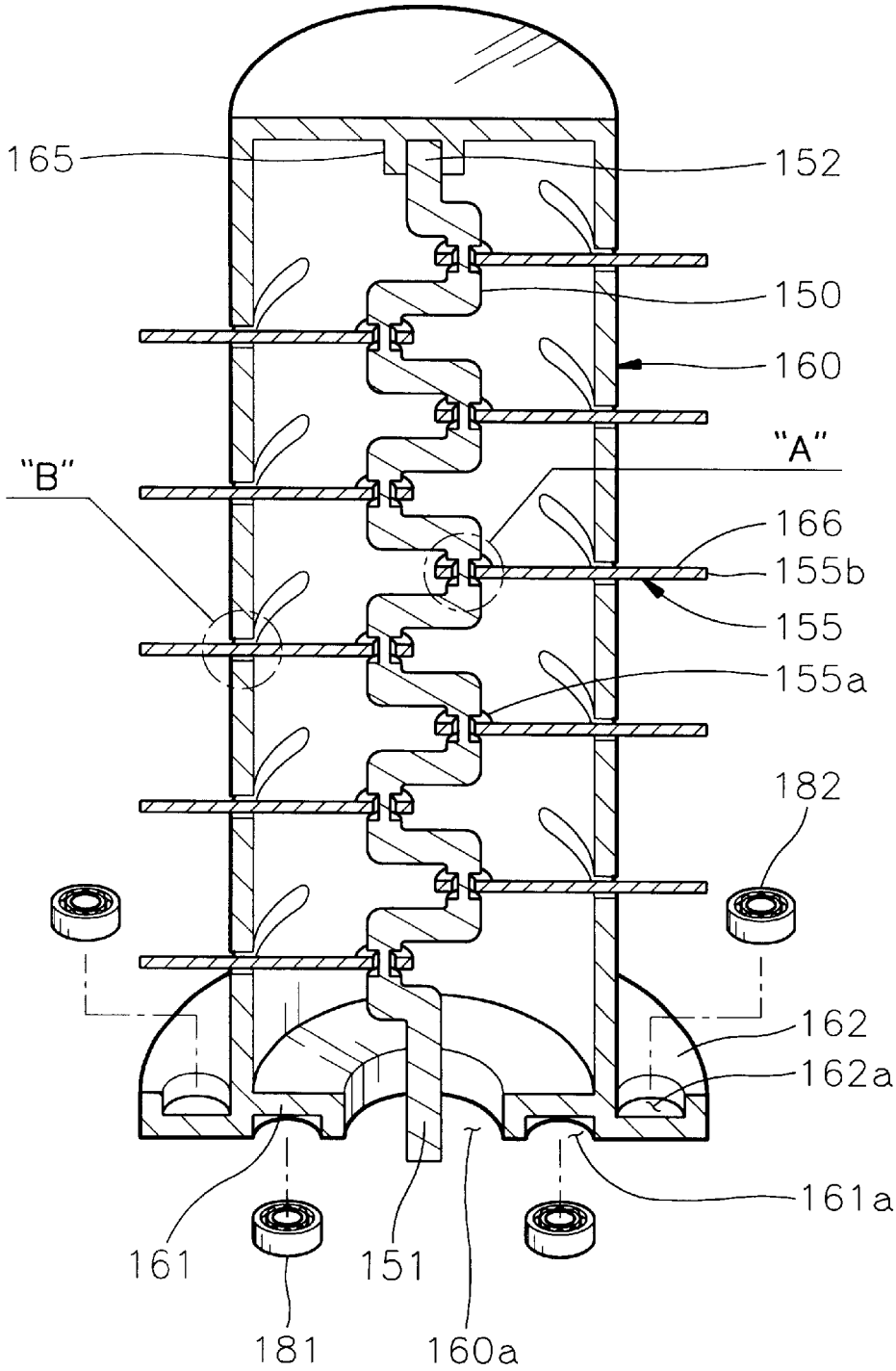
FIG. 4 is a partially sectioned perspective view of a cylinder according to one embodiment of the present invention.
Figure 5:
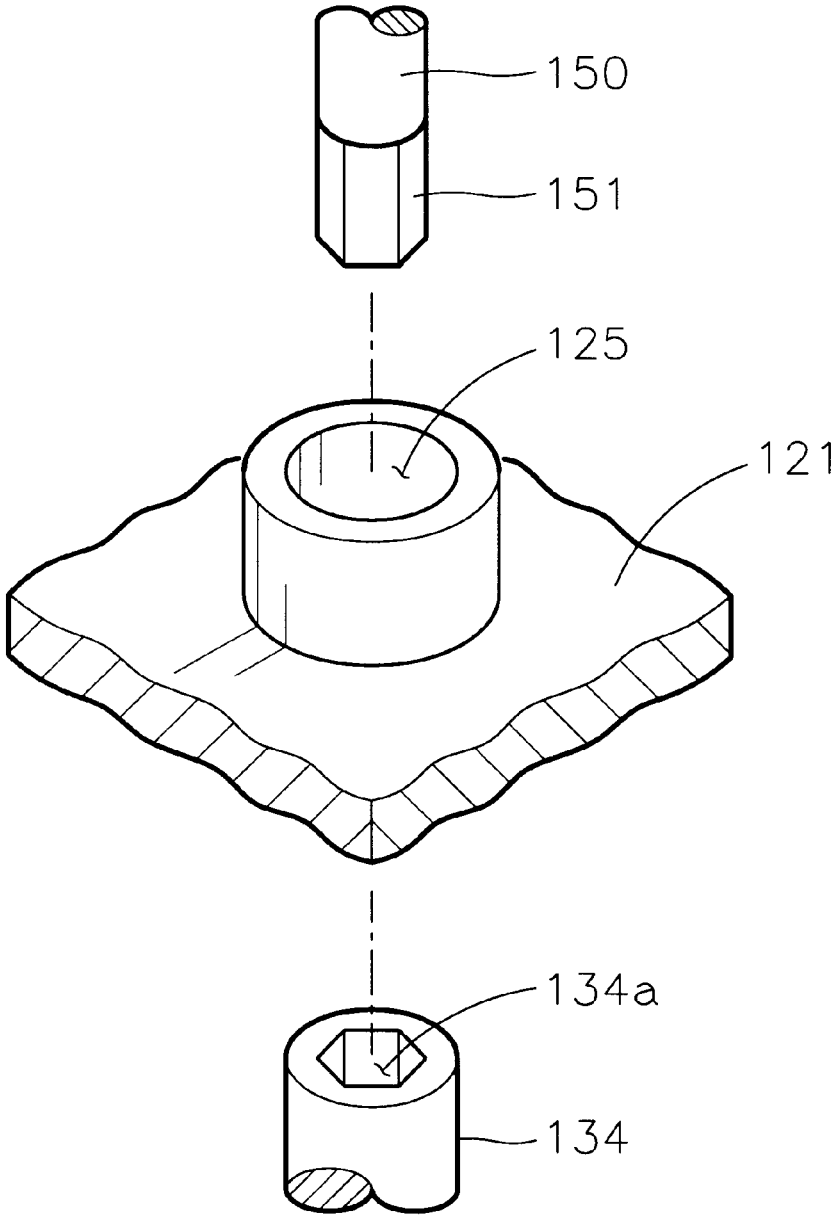
FIG. 5 is a disassembled perspective view of a part "G" illustrated in FIG. 2.
Figure 6:
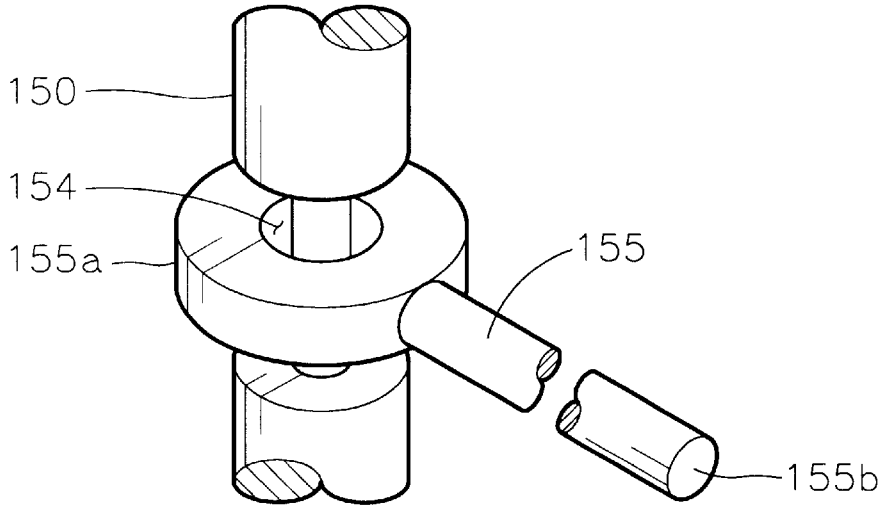
FIG. 6 is an exploded perspective view of a part "A" illustrated in FIG. 4.
Figure 7:
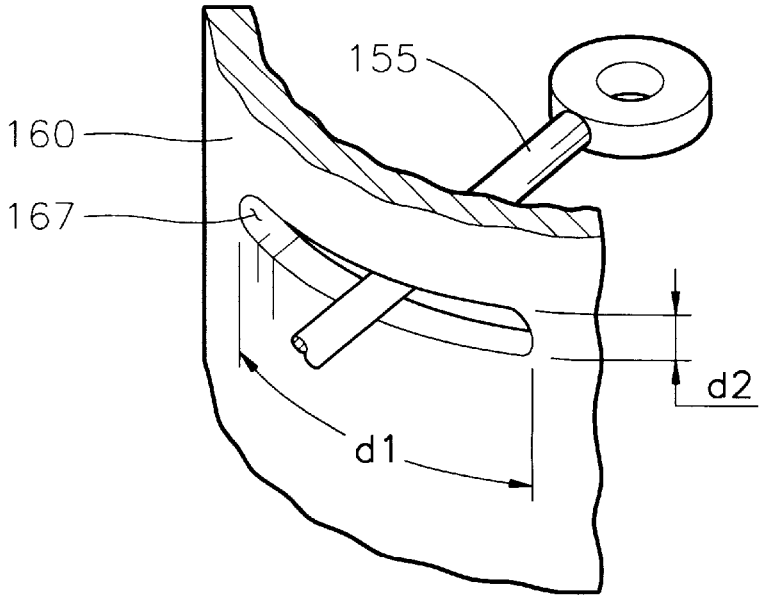
FIG. 7 is an exploded perspective view of a part "B" illustrated in FIG. 4.

FIG. 4 is a partially sectioned perspective view of a cylinder according to one embodiment of the present invention, FIG. 5 is a disassembled perspective view of a part "G" illustrated in FIG. 2, FIG. 6 is an exploded perspective view of a part "A" illustrated in FIG. 4, and FIG. 7 is an exploded perspective view of a part "B" illustrated in FIG. 4.

The cylinder 160 is disposed on an upper surface of the pulsator 120, a lower surface of the cylinder 160 is opened. The cylinder 160 is independently rotated relative to the rotatory movement of the pulsator 120, and is rotated at a lower speed than that of the pulsator 120. In detail, an inner and an outer frames 161 and 162 are respectively extended from a bottom end of the cylinder 160 to an inward and an outward directions of the cylinder 160. The inner and outer frames 161 and 162, respectively, have a plurality of depression portions 161*a* and 162*a*. The depression portions 161*a* is upwardly depressed in the inner frame 161 and the depression portions 162*a* is downwardly depressed in the outer frame 162. Bearings 181 and 182 are respectively placed in the depression portions 161*a* and 162*a*. Namely, the bearings 181 and 182 are respectively located between the inner frame 161 and an upper surface of the pulsator 120, and between the outer frame 162 and an upper surface 143 of the supporting member 140. The cylinder 160 slides off the pulsator 120 by the bearings 181 and 182, when the pulsator 120 and the supporting member 140 is rotated by the washing shaft 134. Therefore, the cylinder 160 is independently rotated relative to the rotatory movement of the pulsator 120, and the supporting member 140 rotates at a lower speed than that of the pulsator 120.

A crank 150 and a plurality of rods 155 for converting the rotatory movement of the washing shaft 134 into linear movement is disposed in the cylinder 160.

An upper portion 152 of the crank 150 is supported by a supporting cylinder 165 of the cylinder 160, and a lower portion 151 of the crank 150 is inserted in an inserting hole 134*a* of the washing shaft 134. The upper portion 152 of the crank 150 is formed to have a round shape and the lower portion 151 of the crank 150 is formed to have a polygonal shape. The supporting cylinder 165 for supporting the upper part 152 of the crank 150 is formed at an upper surface of the cylinder 160, the inserting hole 134*a* which is inserted in the lower part 151 of the crank 150 is formed at the washing shaft 134. A shape of the inserting hole 134*a* corresponds to the lower part 151 of the crank 150, an inside diameter of the supporting cylinder 160 is larger than a diameter of the upper portion of the crank 150. Therefore, the cylinder 160 is not rotated by the crank 150 which rotates as the washing shaft 134.

A plurality of rods 155 are connected to the crank 150. A first end 155*a* of the rod 155 is connected to the crank 150 and a second end 155*b* of the rod 155 is outwardly extended to the cylinder 160. The first end 155*a* of the rod 155 is formed into a shape of a ring and is connected to a groove 154 which is formed on the crank 150. The groove 154 prevents the crank 150 from sliding along the crank 150.

A piercing hole 167 having an elliptical shape is formed at the cylinder 160, the rod 155 pierces through the piercing hole 167. In more detail, a diameter d1 of the piercing hole 167 toward a rotatory direction of the crank 150 is longer than a diameter d2 of the piercing hole 167 toward a length direction of the crank 150. Therefore, an inner surface of the piercing hole 167 does not resist the rod 155 which is horizontally reciprocated by the crank 150.

Figure 8:
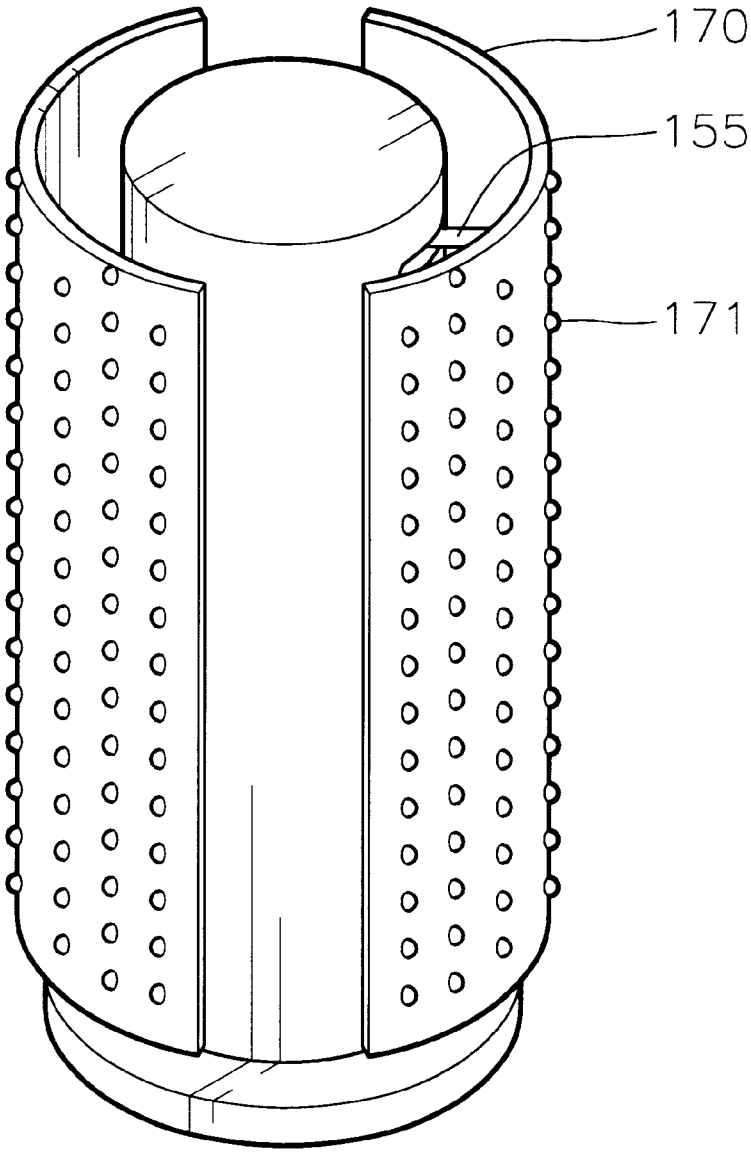
FIG. 8 is an assembled perspective view of the cylinder and washing plates according to one embodiment of the present invention.

FIG. 8 is an assembled perspective view of the cylinder and washing plates according to one embodiment of the present invention, which is explained.

A plurality of washing plates 170 which are positioned at an exterior of the cylinder 160 are connected to the second end 155*b* of the rod 155. The crank 150 and the washing shaft 134 rotates together in forward and reverse directions, the rod 155 horizontally reciprocates. Therefore, the washing plates 170 which is connected to the second end 155*b* of the rod 155, horizontally reciprocate and wash the laundry by means of bumping against the laundry. A plurality of washing protrusions 171 are formed on the washing plates 170 to enlarge a contacting area between the laundry and the washing plates.

Figure 9A:
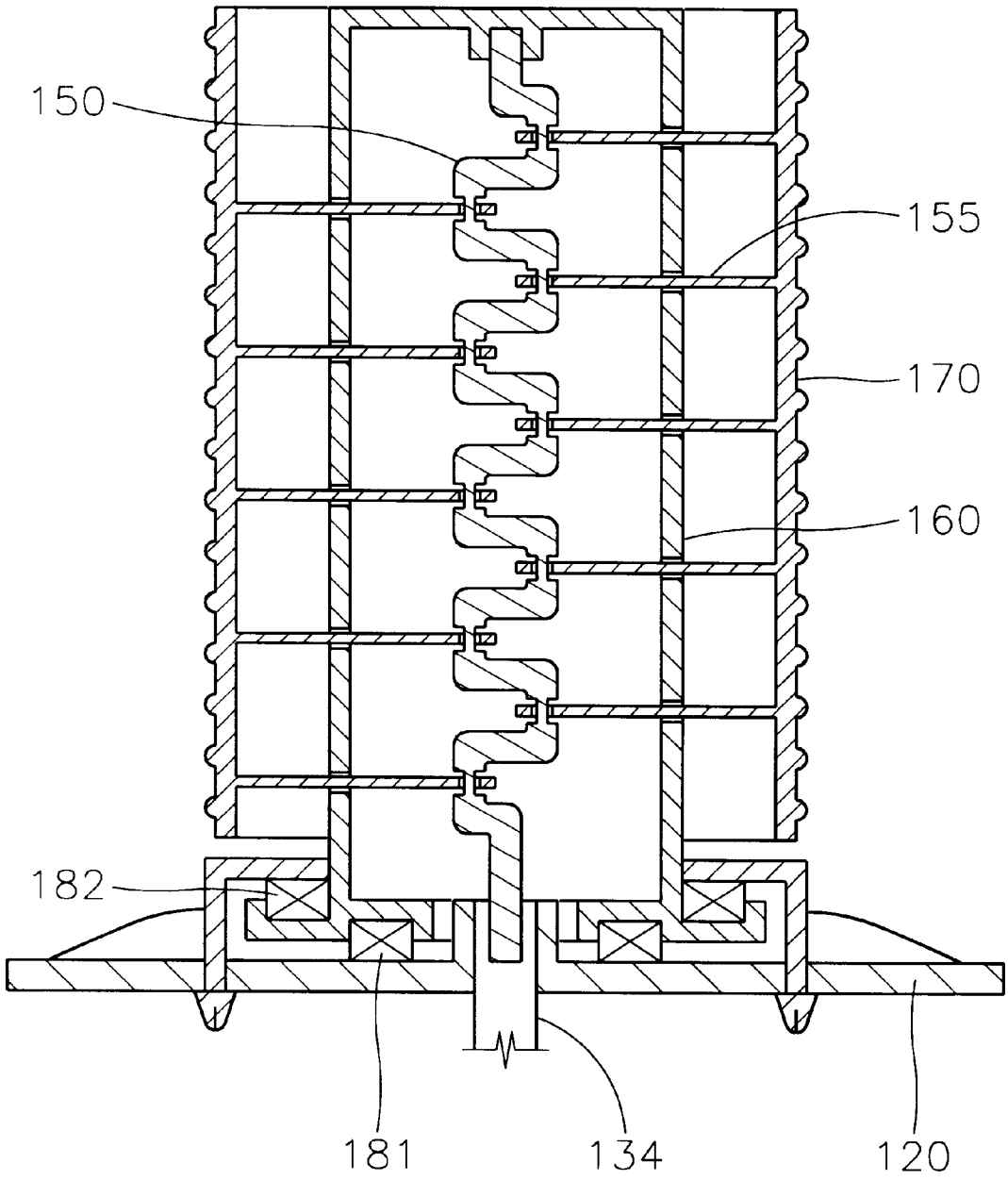
FIGS. 9A, 9B and 9C are vertical sectional views of the washing plates for showing an operation according to one embodiment of the present invention.
Figure 9B:
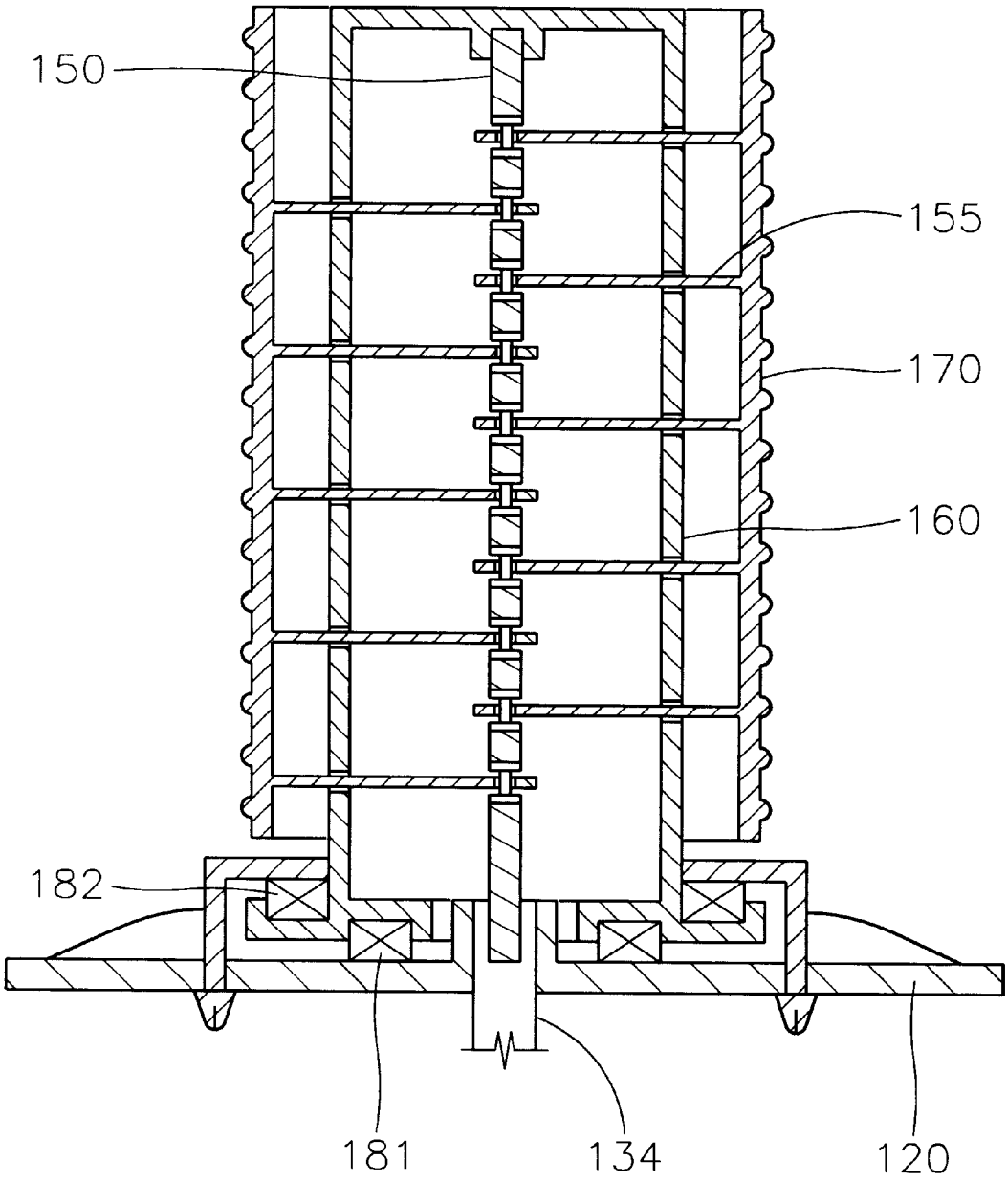
Figure 9C:
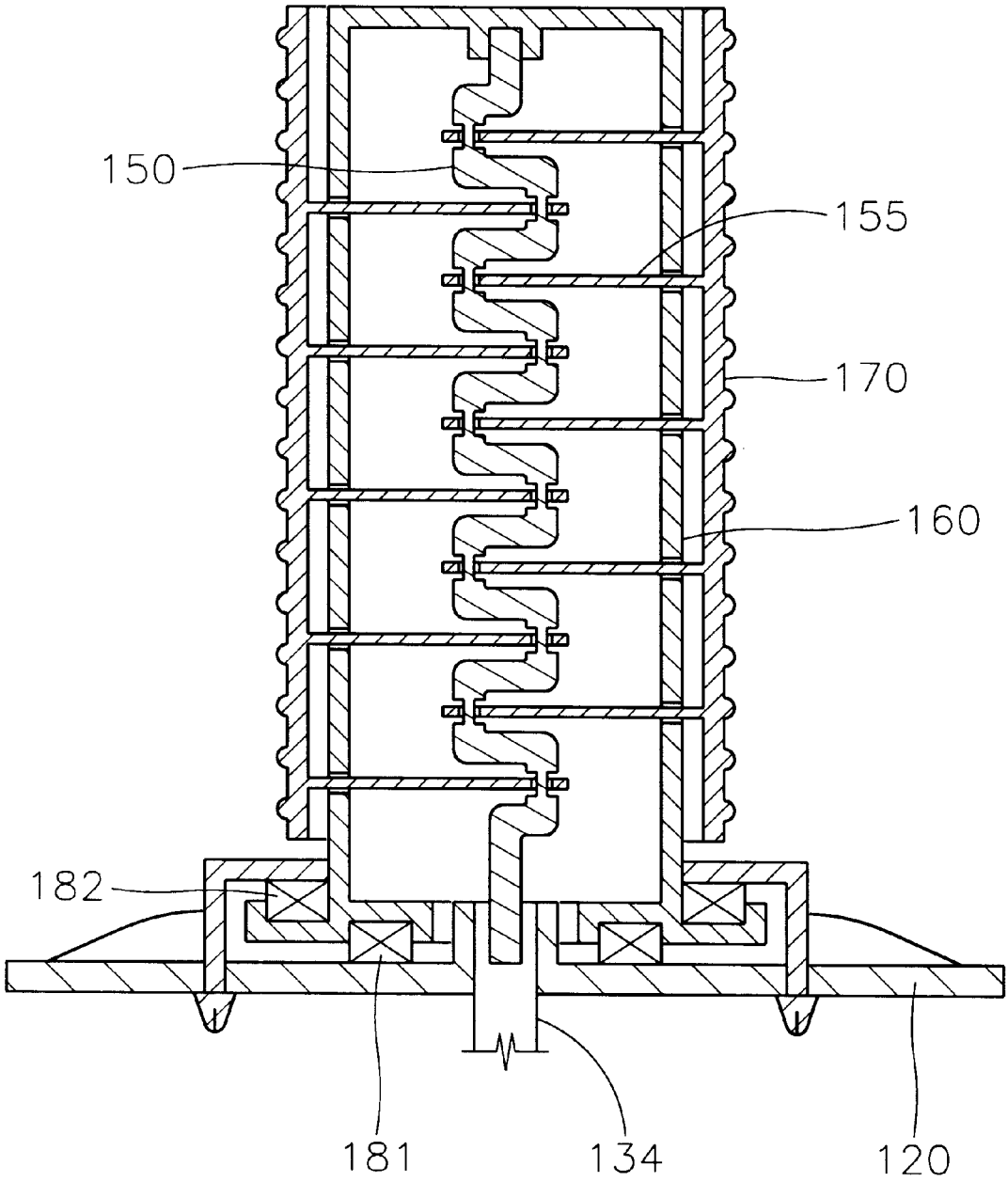

FIGS. 9A, 9B and 9C are a vertical sectional views of the washing plates for showing an operation according to one embodiment of the present invention, which is explained.

The pulsator 120 and the crank 150 are rotated by the washing shaft 134 of the driving unit 130 as a unit, the cylinder 160 slides off the pulsator 120 by the bearings 181 and 182 so that the cylinder 160 rotates at a lower speed than that of the pulsator 120. The rods 155 are reciprocated by the crank 150 in order of FIG. 9A→FIG. 9B→FIG. 9C→FIG. 9A, so that the washing plates 170 are horizontally reciprocated by the rod 155. Therefore, the washing plates 170 bump against the laundry and wash the laundry, when the washing shaft 134 rotates in forward and reverse directions in successively repeated cycles thereof.

As above-described, the washing machine according to the embodiment of the present invention is provided in washing plates which are horizontally reciprocated, so that the washing plates bump against the laundry and wash the laundry. Therefore, washing efficiency is increased.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A washing machine comprising:

an inner tub for receiving a detergent water and a laundry;

a pulsator for agitating the detergent water, which is rotatably mounted in an interior of the inner tub;

a driving unit for rotating in forward and reverse directions the pulsator which is disposed on an exterior of the inner tub, the driving unit having a washing shaft which is connected to the pulsator; and a washing means for bumping against the laundry which is disposed on the pulsator and is horizontally reciprocated by the driving unit to wash the laundry, the washing means including:

a cylinder disposed on an upper surface of the pulsator, the cylinder having an opened lower surface, being independently rotated relative to the rotatory movement of the pulsator, wherein the cylinder rotates at a lower speed than that of the pulsator;

a movement conversion means for converting the rotatory movement of the washing shaft into linear movement which is disposed in the cylinder; and a plurality of washing plates for being horizontally reciprocated by the movement conversion means and for bumping against the laundry, which is positioned in an exterior of the cylinder.

2. The washing machine of claim 1, wherein a supporting member is disposed on the upper surface of the pulsator, the supporting member encloses a side surface of the cylinder for supporting the cylinder and for preventing the cylinder from floating by buoyancy.

3. The washing machine of claim 2, wherein a fixing hole is formed at the pulsator, and a fixing protrusion is inserted into the fixing hole and is extended from the supporting member.

4. The washing machine of claim 3, wherein an inner and an outer frames are respectively extended from a bottom end of the cylinder in an inward and an outward directions of the cylinder, bearings are respectively installed between the inner frame and the pulsator, and between the outer frame and an upper surface of the supporting member for sliding the cylinder relative to the rotatory movement of the pulsator and the supporting member.

5. The washing machine of claim 4, wherein depression portions for placing the bearings are respectively formed at the inner and outer frames.

6. The washing machine of claim 2, wherein the movement conversion means comprises:

a crank installed in an interior of the supporting member, a top end of the crank being supported by the cylinder, and a bottom end of the crank being connected to the washing shaft so that the crank is rotated by the washing shaft; and a rod for converting the rotatory movement of the crank into a linear movement and for transmitting the linear movement into the washing plates, a first end of the rod being connected to the crank and a second end of the rod being connected to the washing plates.

7. The washing machine of claim 6, wherein a piercing hole being pierced by the rod is formed at the cylinder, a diameter of the piercing hole toward a rotatory direction of the crank is longer than that toward a length direction of the crank so that the piercing hole has an elliptical shape.

8. The washing machine of claim 6, wherein the top end of the crank is formed into a round shape and the bottom end of the crank is formed into a polygonal shape, a supporting cylinder for supporting the top end of the crank is formed at an upper surface of the cylinder, a inserting hole for being inserted the bottom end of the crank and having a polygonal shape corresponding to the bottom end of the crank end is formed at the washing shaft.

9. The washing machine of claim 6, wherein the first end of the rod is formed into a shape of a ring, a groove for being connected to the first end of the rod is formed at the crank.

10. The washing machine of claim 2, wherein a plurality of washing protrusions are formed on the washing plates to enlarge a contacting area between the laundry and the washing plates.

11. A washing machine comprising:

an inner tub for receiving a detergent water and a laundry;

a pulsator for agitating the detergent water which is rotatably mounted in an interior of the inner tub;

a driving unit for rotating in forward and reverse directions the pulsator which is disposed on an exterior of the inner tub, the driving unit having a washing shaft which is connected to the pulsator;

a cylinder disposed on an upper surface of the pulsator, the cylinder having a opened lower surface, being independently rotated relative to the rotatory movement of the pulsator, wherein the cylinder rotates at a lower speed than that of the pulsator;

a supporting member is disposed on the upper surface of the pulsator, the supporting member encloses a side surface of the cylinder for supporting the cylinder and for preventing the cylinder from floating by buoyancy;

a plurality of washing plates for being horizontally reciprocated and for bumping against the laundry, which is positioned in an exterior of the cylinder, wherein a plurality of washing protrusions are formed on the washing plates to enlarge a contacting area between the laundry and the washing plates;

a crank installed in an interior of the supporting member, a top end of the crank being supported by the cylinder, and a bottom end of the crank being connected to the washing shaft so that the crank is rotated by the washing shaft; and a rod for converting the rotatory movement of the crank into a linear movement and for transmitting the linear movement into the washing plates, a first end of the rod being connected to the crank and a second end of the rod being connected to the washing plates.

12. The washing machine of claim 11, wherein a fixing hole is formed at the pulsator, and a fixing protrusion is inserted into the fixing hole and is extended from the supporting member.

13. The washing machine of claim 11, wherein an inner and an outer frames are respectively extended from a bottom end of the cylinder in an inward and an outward directions of the cylinder, bearings are respectively installed between the inner frame and the pulsator, and between the outer frame and an upper surface of the supporting member for sliding the cylinder relative to the rotatory movement of the pulsator and the supporting member.

14. The washing machine of claim 13, wherein depression portions for placing the bearings are respectively formed at the inner and outer frames.

15. The washing machine of claim 11, wherein a piercing hole being pierced by the rod is formed at the cylinder, a diameter of the piercing hole toward a rotatory direction of the crank is longer than that toward a length direction of the crank so that the piercing hole has an elliptical shape.

16. The washing machine of claim 11, wherein the top end of the crank is formed into a round shape and the bottom end of the crank is formed into a polygonal shape, a supporting cylinder for supporting the top end of the crank is formed at an upper surface of the cylinder, a inserting hole for being inserted the bottom end of the crank and having a polygonal shape corresponding to the bottom end of the crank end is formed at the washing shaft.

17. The washing machine of claim 11, wherein the first end of the rod is formed into a shape of a ring, a groove for being connected to the first end of the rod is formed at the crank.

* * * * *